US011510492B1

(12) United States Patent
Chapman et al.

(10) Patent No.: US 11,510,492 B1
(45) Date of Patent: Nov. 29, 2022

(54) STORAGE BOX

(71) Applicant: FRESHLINK PRODUCT DEVELOPMENT, LLC, Montclair, NJ (US)

(72) Inventors: Dean Chapman, Montclair, NJ (US); Benjamin Broerman, Hoboken, NJ (US); David Song, Bloomfield, NJ (US)

(73) Assignee: Freshlink Product Development, LLC, Montclair, NJ (US)

( * ) Notice: Subject to any disclaimer, the term of this patent is extended or adjusted under 35 U.S.C. 154(b) by 0 days.

(21) Appl. No.: 17/478,144

(22) Filed: Sep. 17, 2021

(51) Int. Cl.

| | |
|---|---|
| ***A47B 88/994*** | (2017.01) |
| ***A47B 88/975*** | (2017.01) |
| ***A47B 88/981*** | (2017.01) |
| ***A47B 88/969*** | (2017.01) |

(52) U.S. Cl.
CPC ..... *A47B 88/994* (2017.01); *A47B 88/975* (2017.01); *A47B 88/981* (2017.01); *A47B 2088/976* (2017.01)

(58) Field of Classification Search
CPC ... A47B 88/969; A47B 88/975; A47B 88/981; A47B 88/988; A47B 88/994; A47B 2088/202; A47B 2088/205; A47B 2088/207; A47B 2088/976; A47B 2088/977; A47B 77/14
See application file for complete search history.

(56) References Cited

U.S. PATENT DOCUMENTS

| | | | | |
|---|---|---|---|---|
| 2,507,366 A * | 5/1950 | Budalsteveg | ..... | A47B 88/90 220/546 |
| 3,179,278 A * | 4/1965 | Cohen | ..... | B65D 21/086 220/8 |
| 4,577,773 A | 3/1986 | Bitel | | |
| 4,756,581 A * | 7/1988 | Phillips | ..... | B42F 17/10 312/348.3 |

(Continued)

FOREIGN PATENT DOCUMENTS

| | | |
|---|---|---|
| CN | 204688606 U | 10/2015 |
| CN | 213551413 U | 6/2021 |

(Continued)

OTHER PUBLICATIONS

Combined Search and Examination Report issued to U.K. counterpart application No. 2113261.8 by the UKIPO dated Feb. 18, 2022.

*Primary Examiner* — Andrew M Roersma
(74) *Attorney, Agent, or Firm* — Burris Law, PLLC

(57) ABSTRACT

A storage box includes at least one storing unit including a main box and at least one dividing plate. The main box includes two first engaging subunits and a main box body defining a dividable space. Each of the first engaging subunits is formed on a top end of the main box body and includes a plurality of spaced-apart first engaging members. The at least one dividing plate has a plate body and two second engaging members. The plate body is disposed removably in the dividable space and divides the dividable space into two storage areas. The second engaging members respectively and separably engage one of the first engaging (Continued)

members of one of the first engaging subunits and one of the first engaging members of the other one of the first engaging subunits.

16 Claims, 10 Drawing Sheets

(56) References Cited

U.S. PATENT DOCUMENTS

| | | | | | |
|---|---|---|---|---|---|
| 4,909,406 | A * | 3/1990 | Wu | A45C 11/38 | 220/8 |
| 5,111,959 | A * | 5/1992 | Glickman | A47B 88/969 | 220/544 |
| 5,738,425 | A * | 4/1998 | Rosenberg | A47B 88/994 | 312/348.3 |
| 2008/0202976 | A1 * | 8/2008 | Burgess | A47B 88/994 | 206/557 |
| 2011/0084584 | A1 * | 4/2011 | Curtin | A47B 97/00 | 312/348.3 |
| 2012/0319550 | A1 * | 12/2012 | Manniso | A47B 88/994 | 312/348.3 |
| 2014/0291181 | A1 | 10/2014 | Yang | | |

FOREIGN PATENT DOCUMENTS

| | | | | | |
|---|---|---|---|---|---|
| GB | 1447402 | A * | 8/1976 | A47B 88/20 | |
| JP | 2001213438 | A | 8/2001 | | |
| KR | 200321800 | Y1 * | 7/2003 | A47B 88/975 | |
| WO | WO-2020250271 | A1 * | 12/2020 | | |
| WO | WO-2021254796 | A1 * | 12/2021 | | |

* cited by examiner

STORAGE BOX

FIELD

The disclosure relates to a storage product, and more particularly to a storage box.

BACKGROUND

A conventional storage box used for storing various items, such as knives, forks and spoons in a kitchen, generally has a plurality of compartmented storage spaces that are in different sizes and that are not adjustable. The size of each of the compartmented storage spaces is decided by a manufacturer that produces the conventional storage box, and is decided according to the presumed types and sizes of items that a customer may store in the conventional storage box.

However, even though the manufacturer provides the conventional storage box with the compartmented storage spaces that differ in sizes, the compartmented storage spaces may not always meet the customer's needs. That is to say, items that the customer wants to store may not fit into any one of the storage spaces of the conventional storage box because the storage spaces are not adjustable according to the number and size of the items. Moreover, because the size of the conventional storage box is not adjustable, the customer may have difficulty in putting the conventional storage box in a drawer as the conventional storage box may not fit into the drawer.

SUMMARY

Therefore, an object of the disclosure is to provide a storage box that can alleviate at least one of the drawbacks of the prior art.

According to the disclosure, the storage box includes at least one storing unit including a main box and at least one dividing plate. The main box is elongated in a longitudinal direction, and includes a main box body and two first engaging subunits. The main box body defines a dividable space having an upward-facing top opening. The first engaging subunits are spaced apart from each other in a transverse direction which is perpendicular to the longitudinal direction, and are formed on a top end of the main box body. Each of the first engaging subunits includes a plurality of spaced-apart first engaging members arranged in the longitudinal direction. The at least one dividing plate has a plate body and two second engaging members. The plate body is disposed removably in the dividable space and divides the dividable space into two storage areas. The second engaging members are opposite to each other in the transverse direction, are respectively connected to two opposite ends of the plate body, and respectively and separably engage one of the first engaging members of one of the first engaging subunits and one of the first engaging members of the other one of the first engaging subunits.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
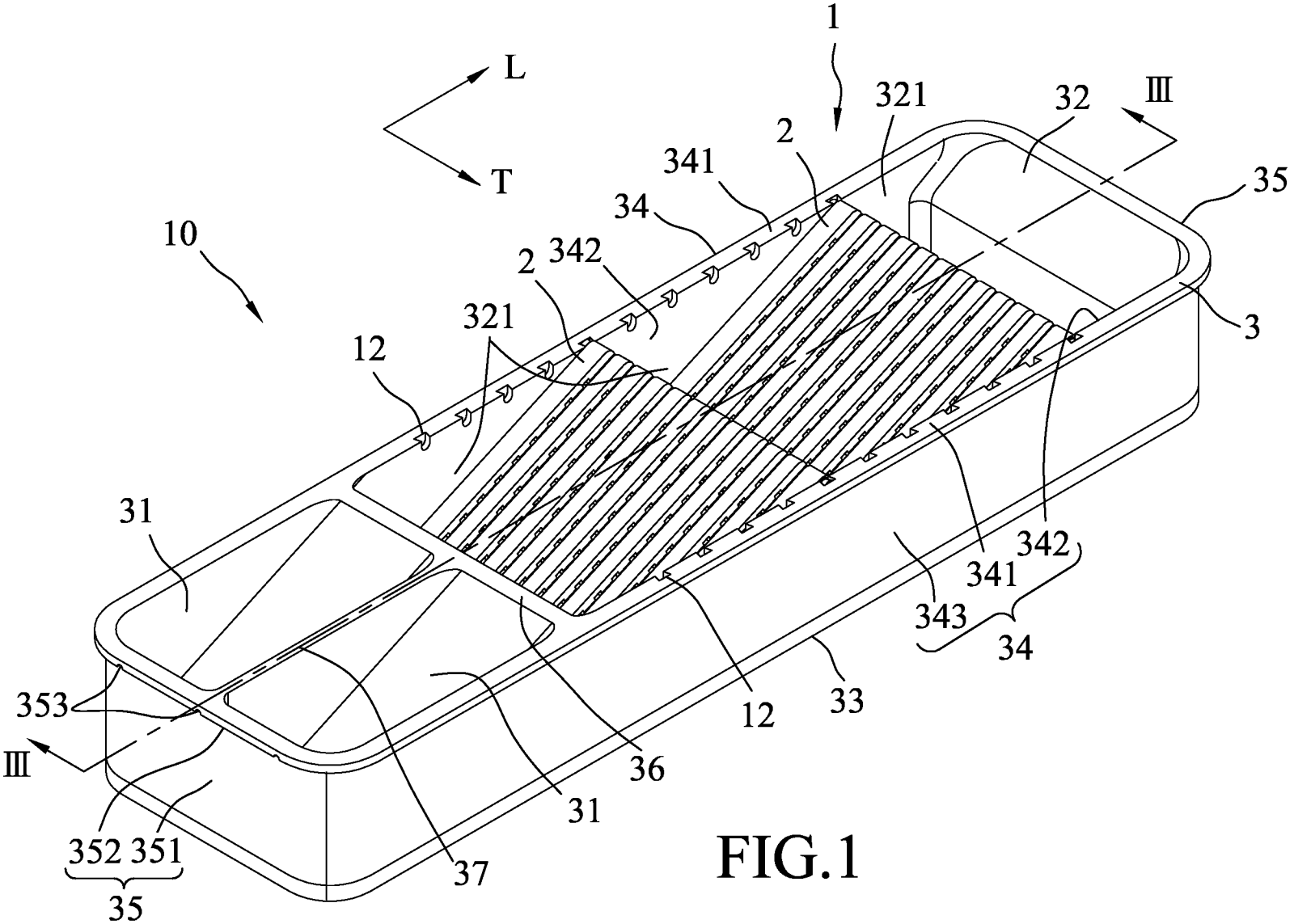
FIG. 1 is a perspective view of a first embodiment of a storage box according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
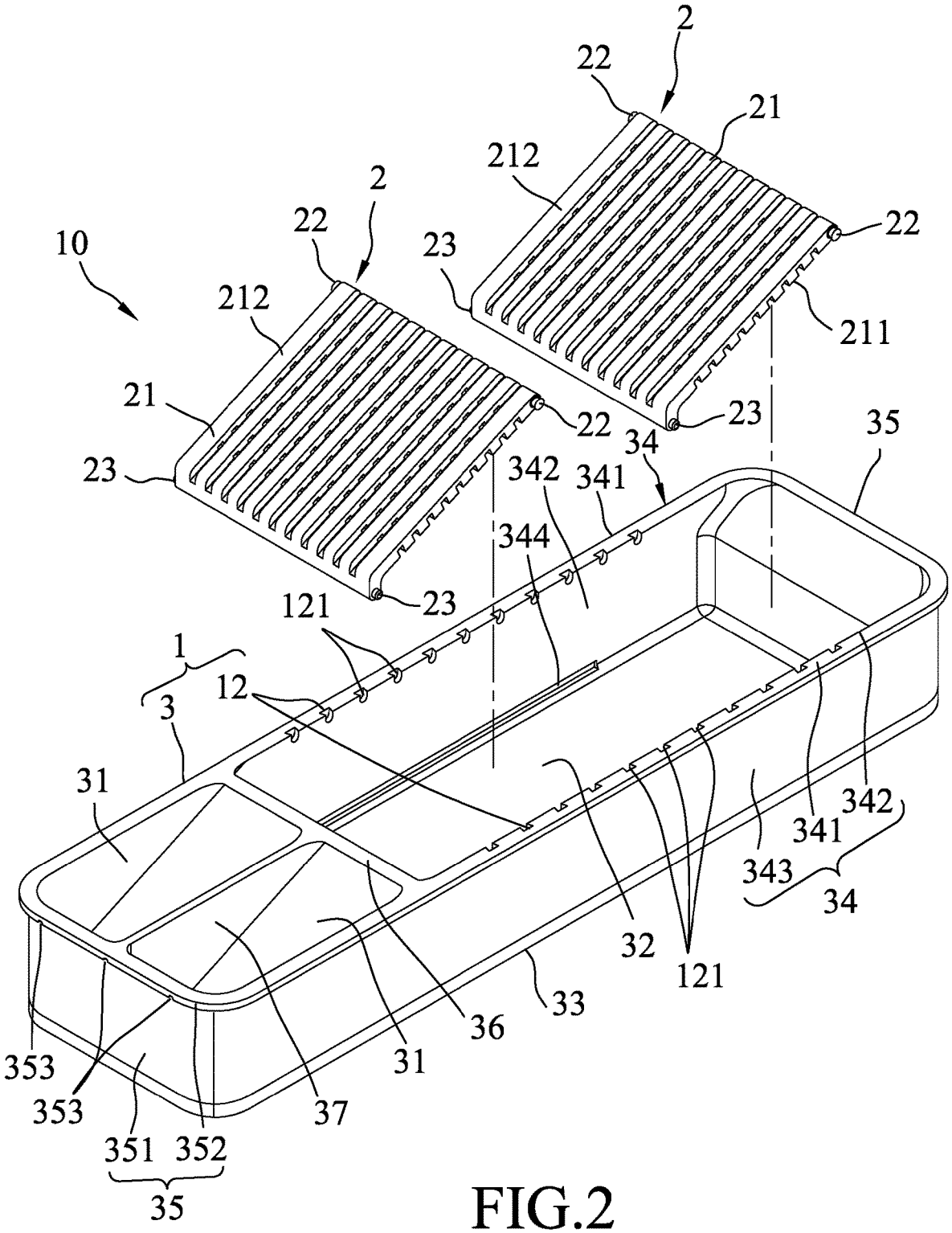
FIG. 2 is an exploded perspective view of the first embodiment.
Figure 3:
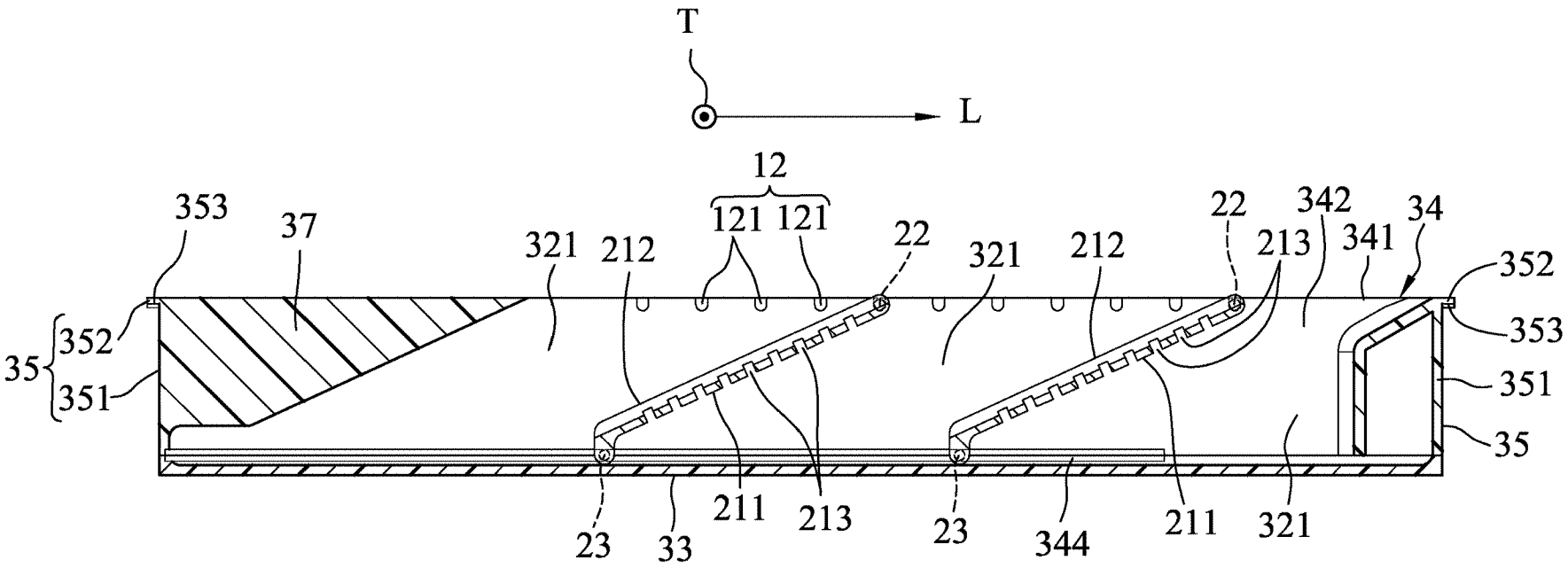
FIG. 3 is a sectional view taken along line III-III of FIG. 1.

Referring to FIGS. 1 to 3, a first embodiment of a storage box according to the disclosure is adapted to store a plurality of items (not shown) and includes a storing unit 10. The storing unit 10 includes a main box 1 elongated in a longitudinal (i.e., front-rear) direction (L) and a plurality of dividing plates 2 separably engaging the main box 1.

Atop view of the main box 1 is rectangular-shaped. The main box 1 includes a main box body 3 and two first engaging subunits 12. The main box body 3 defines two storing spaces 31 located at the front thereof and arranged in a transverse direction (T) which is perpendicular to the longitudinal direction (L), and a dividable space 32 located at the rear of the main box body 3. Each of the storing spaces 31 and the dividable space 32 has an upward-facing top opening. The first engaging subunits 12 are formed on a top end of the main box body 3.

The main box body 3 has a main base wall 33, two first side walls 34, two second side walls 35, a first dividing wall 36 and a second dividing wall 37. The main base wall 33 is rectangular, is elongated in the longitudinal direction (L) and has two first edges opposite to each other in the transverse direction (T). The first side walls 34 extend upwardly and respectively from the first edges of the main base wall 33. The second side walls 35 are spaced apart from each other in the longitudinal direction (L) and interconnect the first side walls 34. Specifically, one of the second side walls 35 is at the front of the main box body 3 and interconnects front ends of the first side walls 34, while the other one of the second side walls 35 is at the rear of the main box body 3 and interconnects the rear ends of the first side walls 34. The first dividing wall 36 is inclined, is located between the second side walls 35 and interconnects the first side walls 34. Specifically, the first dividing wall 36 is inclined in a manner that a bottom edge thereof is closer to the one of the second side walls 35 at the front of the main box body 3 than a top edge of the first dividing wall 36, and that each of the bottom edge and the top edge thereof interconnects the first side walls 34. The second dividing wall 37 is located between the first side walls 34 and interconnects the first dividing wall 36 and the one of the second side walls 35 that the bottom edge of the first dividing wall 36 is close to. Each of the second side walls 35 has a side wall section 351 extending upwardly from the main base wall 33, and a flange section 352 extending from a top end of the side wall section 351 and away from another one of the second side walls 35. Specifically, the flange sections 352 are perpendicular to the side wall section 351.

The first side walls 34, the other one of the second side walls 35 at the rear of the main box body 3, and the first dividing wall 36 cooperatively define the dividable space 32. The one of the second side walls 35 at the front of the main box body 3, the first dividing wall 36 and the second dividing wall 37 cooperate with one of the first side walls 34 to define one of the storing spaces 31, and cooperate with the other one of the first side walls 34 to define the other one of the storing spaces 31. The storing spaces 31 are isolated from the dividable space 32.

The first side walls 34 of the main box body 3 are in the same shape and correspond in position to each other in the transverse direction (T). Each of the first side walls 34 has a first top surface 341, a first inner lateral surface 342, a first outer lateral surface 343 and a slide groove 344. The first top surface 341 faces away from the main base wall 33 of the main box body 3. The first inner lateral surface 342 extends downwardly from the first top surface 341 and faces the dividable space 32 of the main box body 3 (i.e., the first inner lateral surfaces 342 of the first side walls 34 face each other). The first outer lateral surface 343 extends downwardly from the first top surface 341 and is opposite to the dividable space 32. The slide groove 344 is indented at a bottom portion of the first inner lateral surface 342, extends in the longitudinal direction (L) and is in the shape of a long strip.

The second side walls 35 of the main box body 3 are in the same shape and correspond in position to each other in the longitudinal direction (L). The flange section 352 of each of the second side walls 35 is formed with a plurality of positioning notches 353 spaced apart from each other, arranged in the transverse direction (T), and opening downwardly. The width of each of the positioning notches 353 in the transverse direction (T) decreases along an upward direction.

Each of the first engaging subunit 12 is formed on a top end of a respective one of the first side walls 34 of the main box body 3. The first engaging subunits 12 are spaced apart from each other in the transverse direction (T). Each of the first engaging subunits 12 includes a plurality of spaced-apart first engaging members 121 arranged in the longitudinal direction (L). In this embodiment, for each first engaging subunit 12, each of the first engaging members 121 is an indentation formed in an intersection of the first top surface 341 and the first inner lateral surface 342 of the respective one of the first side walls 34, and having a semi-circular shape that has a width in the longitudinal direction (L) decreasing in a downward direction.

Each of the dividing plates 2 has a plate body 21, two second engaging members 22 and two sliding members 23. The plate body 21 is disposed removably in the dividable space 32 of the main box body 3. The second engaging members 22 are respectively connected to two opposite ends of a top portion of the plate body 21. The sliding members 23 protrude respectively from opposite ends of a bottom portion of the plate body 21 in the transverse direction (T). Each of the dividing plates 2 is symmetrical in the transverse direction (T).

The plate body 21 of each of the dividing plates 2 has a first plate surface 211 facing the main base wall 33 of the main box body 3, a second plate surface 212 opposite to the first plate surface 211, and a plurality of through holes 213 spaced apart from each other. Each of the through holes 213 extends through the first plate surface 211 and the second plate surface 212. In this embodiment, the second plate surface 212 is formed with a plurality of trenches that are spaced apart from each other in the transverse direction (T) and that extend from the top portion to the bottom portion of the plate body 21.

The second engaging members 22 of each of the dividing plates 2 are opposite to each other in the transverse direction (T) and respectively extend away from the plate body 21. Specifically, each of the second engaging members 22 is a protrusion, and has a circular cross section that is normal to the transverse direction (T) and that has a diameter increasing as the second engaging member 22 extends away from the plate body 21. The second engaging members 22 of each of the dividing plates 2 respectively and separably engage one of the first engaging members 121 of one of the first engaging subunits 12 and one of the first engaging members 121 of the other one of the first engaging subunits 12. For each dividing plate 2, each of the sliding members 23 engages rotatably and is slidable along the slide groove 344 of a respective one of the first side walls 34 so that the dividing plate 2 is rotatable and linearly movable relative to the main box body 3 when the second engaging members 22 are separated from the first engaging members 121 of the first engaging subunits 12.

Figure 4:
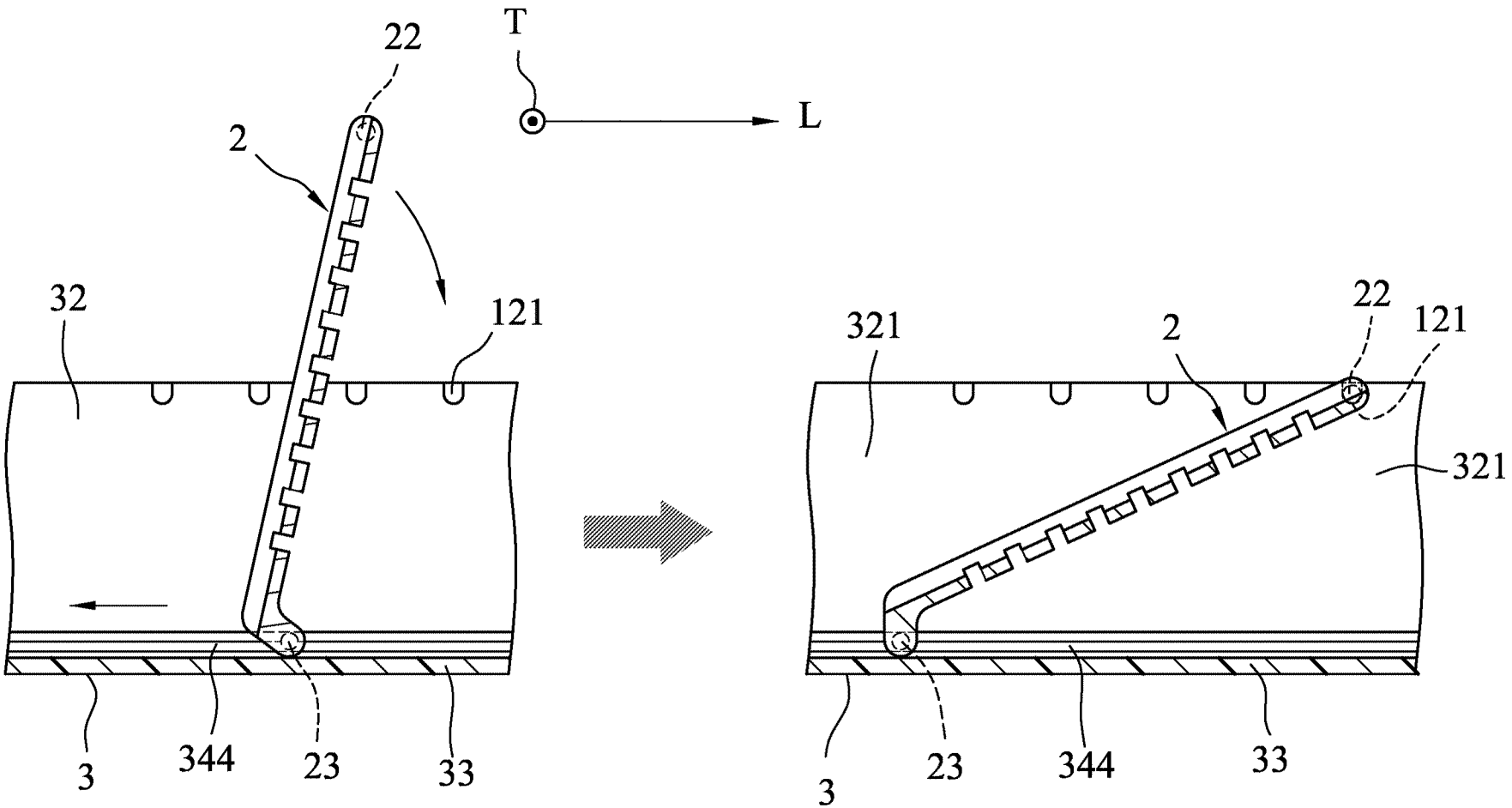
FIG. 4 is a fragmentary sectional view illustrating how a dividing plate of the first embodiment engages a main box of the first embodiment.

Before items are stored in the storage box, the dividing plates 2 may be disposed in the dividable space 32 of the main box body 3 to provide areas suitable for items of different sizes, and the following explains how to dispose each of the dividing plates 2 in the dividable space 32. FIG. 4 illustrates only one of the dividing plates 2 for the purpose of brief and clear explanation. At first, the one of the dividing plates 2 enters the dividable space 32 in a manner that the bottom end thereof is adjacent to the main base wall 33 of the main box body 3, and that one of the sliding members 23 is closer to the first dividing wall 36 of the main box body 3 than the other one of the sliding members 23 (i.e., the second plate surface 212 of the one of the dividing plates 2 faces a corner formed by the first dividing wall 36 and one of the first side walls 34). Next, the one of the dividing plates 2 is turned until an imaginary line connecting the sliding members 23 is parallel to the transverse direction (T) (i.e., the second plate surface 212 of the one of the dividing plates 2 faces the first dividing wall 36). In this way, the sliding members 23 of the one of the dividing plates 2 respectively and sequentially engage the slide grooves 344 of the first side walls 34. Afterwards, the one of the dividing plates 2 is moved in the longitudinal direction (L) along the slide grooves 344 to a position where the second engaging members 22 are allowed to respectively and separably engage one of the first engaging members 121 of one of the first engaging subunits 12 and one of the first engaging members 121 of the other one of the first engaging subunits 12 when the one of the dividing plates 2 is rotated about the imaginary line connecting the sliding members 23. Finally, the one of the dividing plates 2 is rotated (in a clockwise direction in FIG. 4) and the second engaging members 22 engage the first engaging members 121 of the first engaging subunits 12 so that the one of the dividing plates 2 is disposed in the dividable space 32. At this time, the one of the dividing plates 2 is inclined with respect to the main base wall 33 of the main box body 3. Specifically, the first plate surface 211 of the one of the dividing plates 2 cooperates with the main base wall 33 of the main box body 3 to define an acute angle therebetween. Another one of the dividing plates 2 is disposed in the dividable space 32 in the same sequence, and the dividing plates 2 are spaced apart from each other in the longitudinal direction (L). Consequently, the plate body 21 of each of the dividing plates 2 divides the dividable space 32 into two storage areas 321, and the number of the storage areas 321 will be one more than that of the dividing plates 2. As shown in FIG. 1, the storage box is provided with two of the dividing plates 2, and dividable space 32 is divided into three storage areas 321 by the two dividing plates 2.

It is noted that the number of the dividing plates is not limited to two. According to operational requirements, the storage box may include only one dividing plate 2, or may include more than two dividing plates 2.

Because the storage areas 321 of the main box body 3 are adjusted according to the size of individual items before the items are stored in the storage box, when a user uses the storage box to store the items, the items can directly fit into the storage areas 321 and can be properly stored. Therefore, none of the storage areas 321 would be left unusable because of inefficient use of the storage box's space, and the use of the space of the storage box may be optimized. Moreover, it is relatively easy for a user to find one specific item that the user is looking for because the items may be sorted and stored in the storage areas 321 according to their size. Thus, the user may spend less time looking for items in the storage box, and may retrieve the items with higher efficiency. Furthermore, by virtue of the dividing plates 2 being positioned at a slant, and by virtue of the through holes 213 of the dividing plates 2, the storage areas 321 are well-ventilated so that even if the items were sorted and stored while still wet, the items may be left to dry in the box.

The storage box may be used in various places and in different ways. When the storage box is used in a kitchen or a restaurant, items such as knives, forks, spoons, chopstick rests or rubber bands may be stored in the storage box. Since knives, forks and spoons are generally elongated, they may be sorted and then stored in the storage areas 321 of the main box body 3 by leaning them against the second plate surfaces 212 of the dividing plates 2. Chopstick rests, rubber bands or other items that are generally shorter than the abovementioned elongated items may be stored in the storing spaces 31 of the main box body 3.

In addition, the storage box may be used to store stationery, hand tools or miscellaneous household items, especially items of different sizes. Because each of the dividing plates 2 is linearly movable relative to the main box body 3 in the longitudinal direction (L), the volume of each of the storage areas 321 of the main box body 3 is adjustable. Therefore, the storage box may store items that vary greatly in size and type, and the utility of the dividable space 32 of the main box body 3 is increased. Furthermore, when an item is too long to fit in anyone of the storage areas 321, the dividing plates 2 are allowed to be removed from the main box body 3 so that the item can be stored in the dividable space 32.

Figure 5:
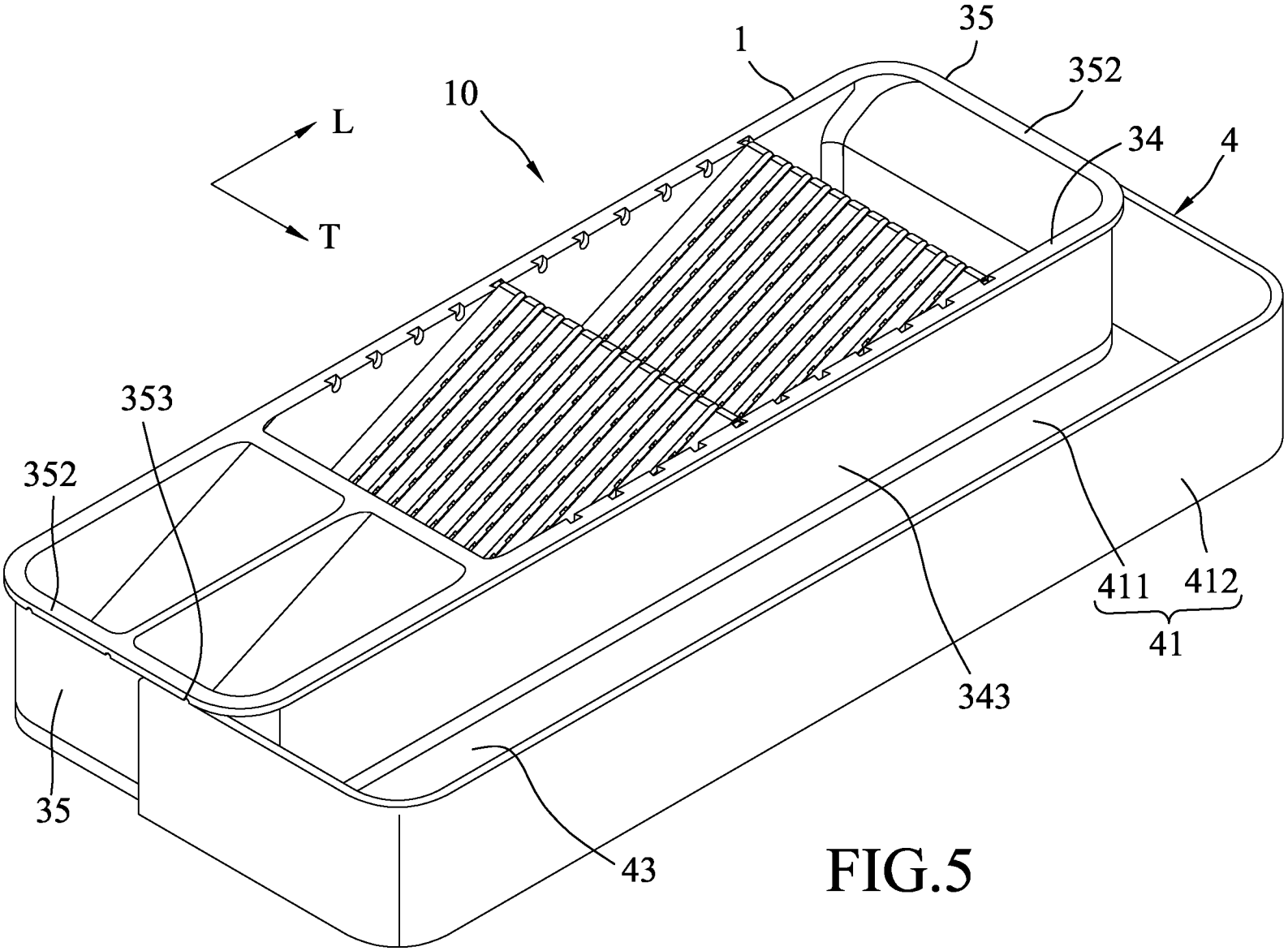
FIG. 5 is a perspective view of a second embodiment of the storage box.
Figure 6:
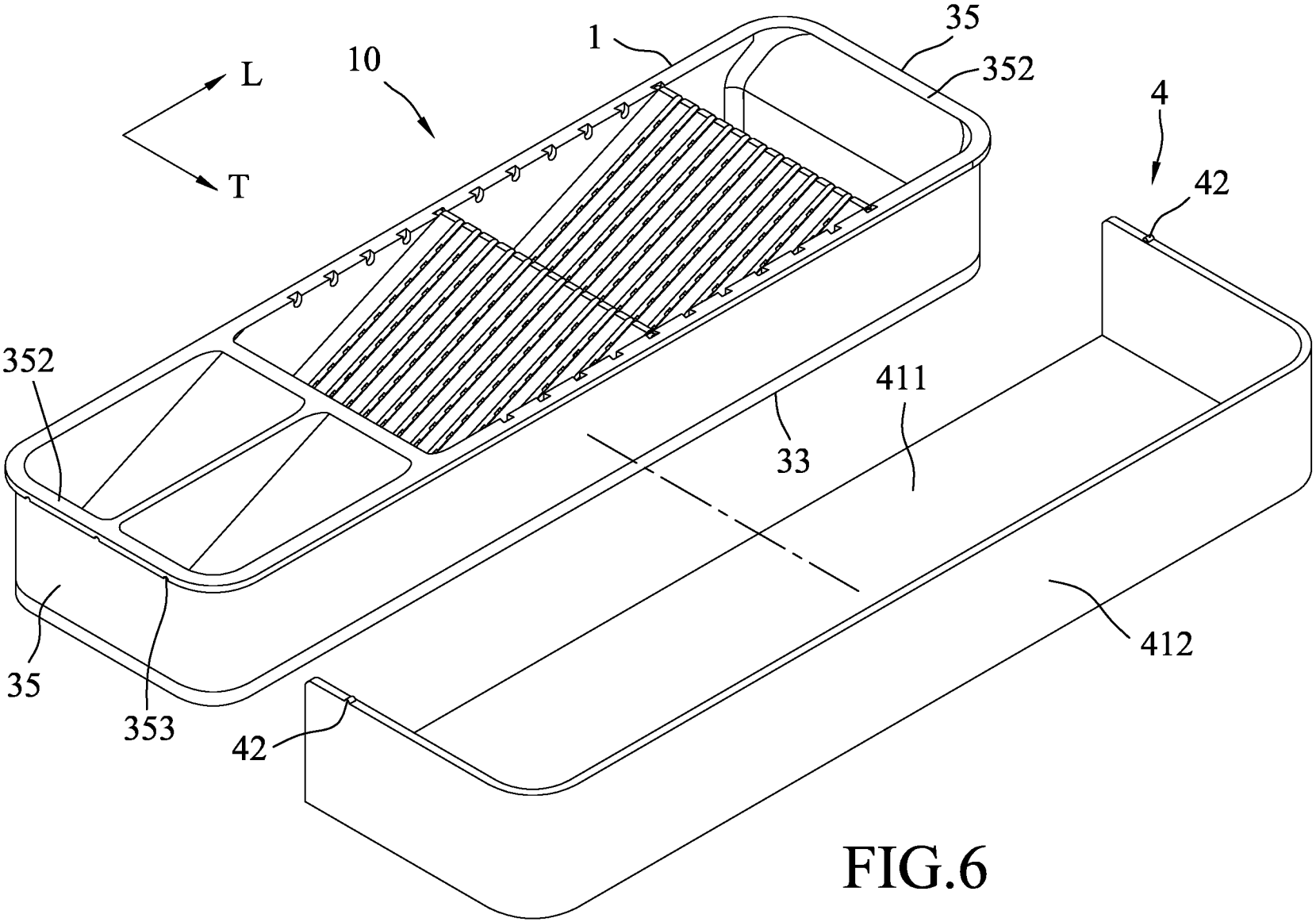
FIG. 6 is a partly exploded perspective view of the second embodiment.

Referring further to FIGS. 5 and 6, a second embodiment of the storage box according to the disclosure is similar to the first embodiment. A difference between the first embodiment and the second embodiment is that the storing unit 10 of the second embodiment further includes an auxiliary box 4 movably coupled to the main box 1.

The auxiliary box 4 includes an auxiliary box body 41 and two positioning protrusions 42. The auxiliary box body 41 has an auxiliary base wall 411 elongated in the longitudinal direction (L), and an auxiliary side wall 412. The auxiliary base wall 411 has two second edges opposite to each other in the longitudinal direction (L), and two third edges opposite to each other in the transverse direction (T) and interconnecting the second edges. The auxiliary side wall 412 extends upwardly from the second edges and one of the third edges of the auxiliary base wall 411. The other one of the third edges of the auxiliary base wall 411 abuts against a bottom surface of the main base wall 33 of the main box body 3. The positioning protrusions 42 are spaced apart from each other in the longitudinal direction (L), are respectively located over the second edges of the auxiliary base wall 411, and protrude upwardly from the auxiliary side wall 412. Each of the positioning protrusions 42 separably engages one of the positioning notches 353 of the flange section 352 of a respective one of the second side walls 35.

When the auxiliary box 4 and the main box 1 are coupled together, the auxiliary box body 41 cooperates with the first outer lateral surface 343 of one of the first side walls 34 to define an auxiliary space 43 having an upward-facing top opening. Therefore, the total volume of storage spaces of the storage box is increased.

Figure 7:
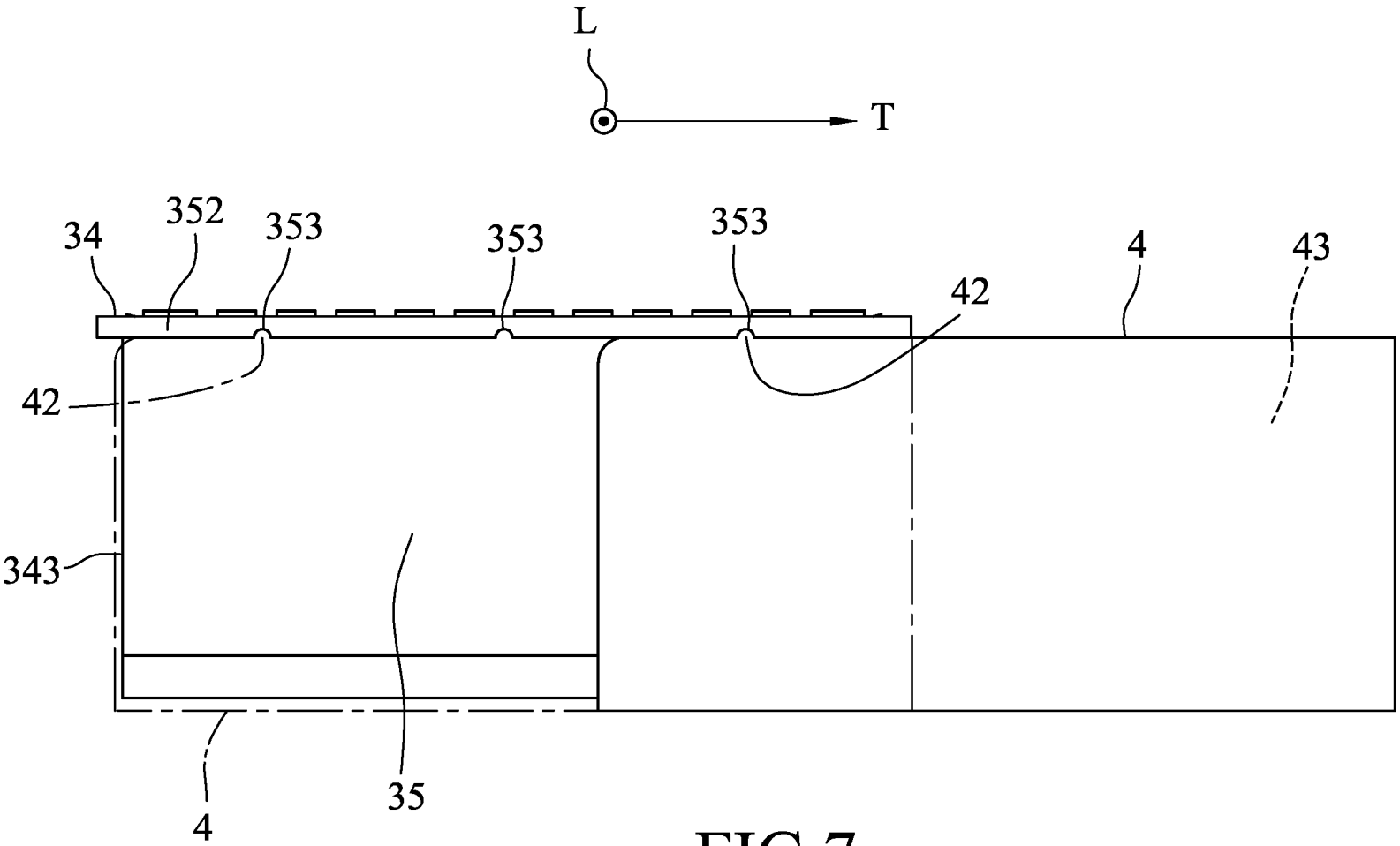
FIG. 7 is a front view of the second embodiment.
Figure 8:
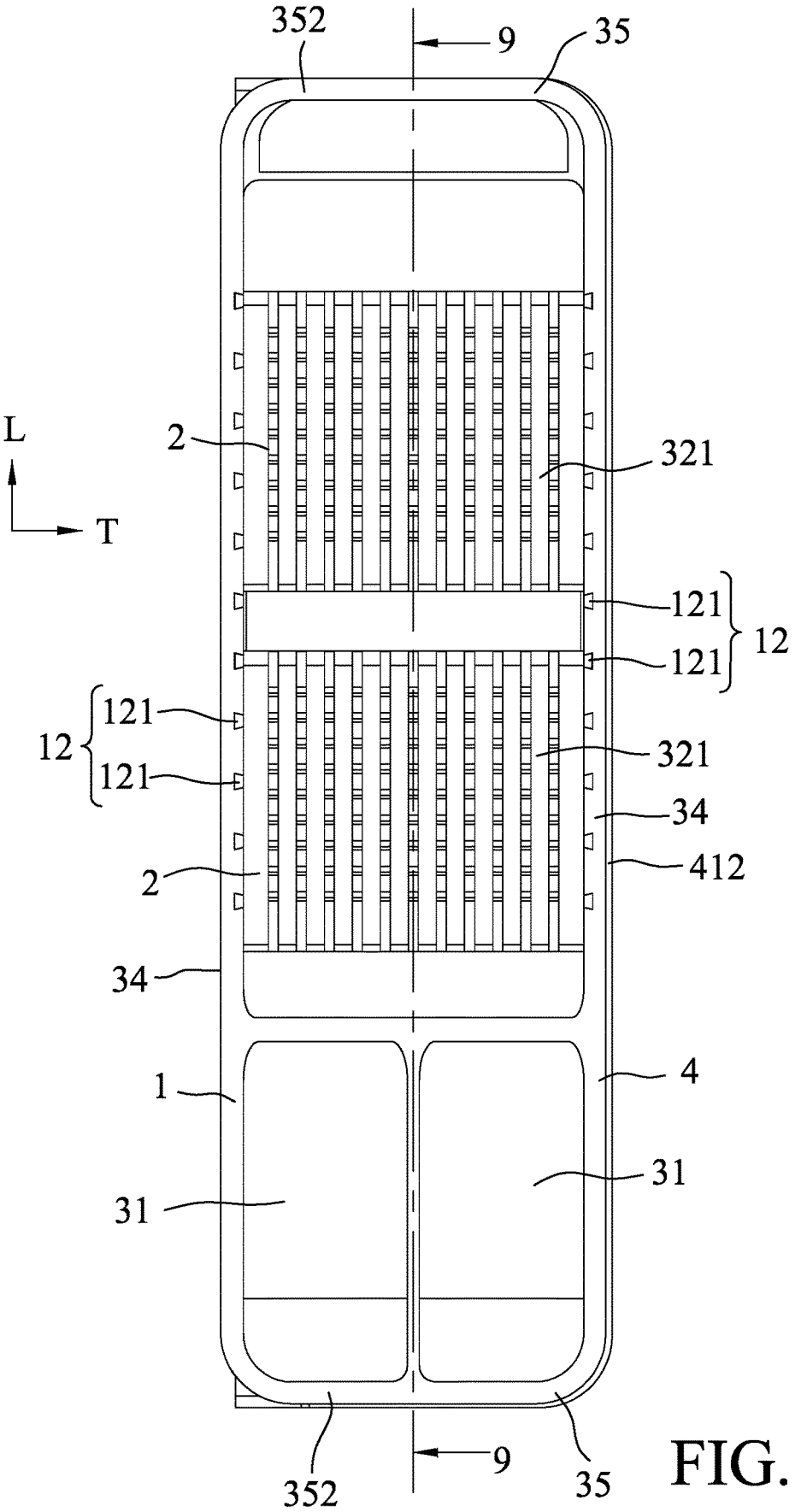
FIG. 8 is a top view of the second embodiment.
Figure 9:
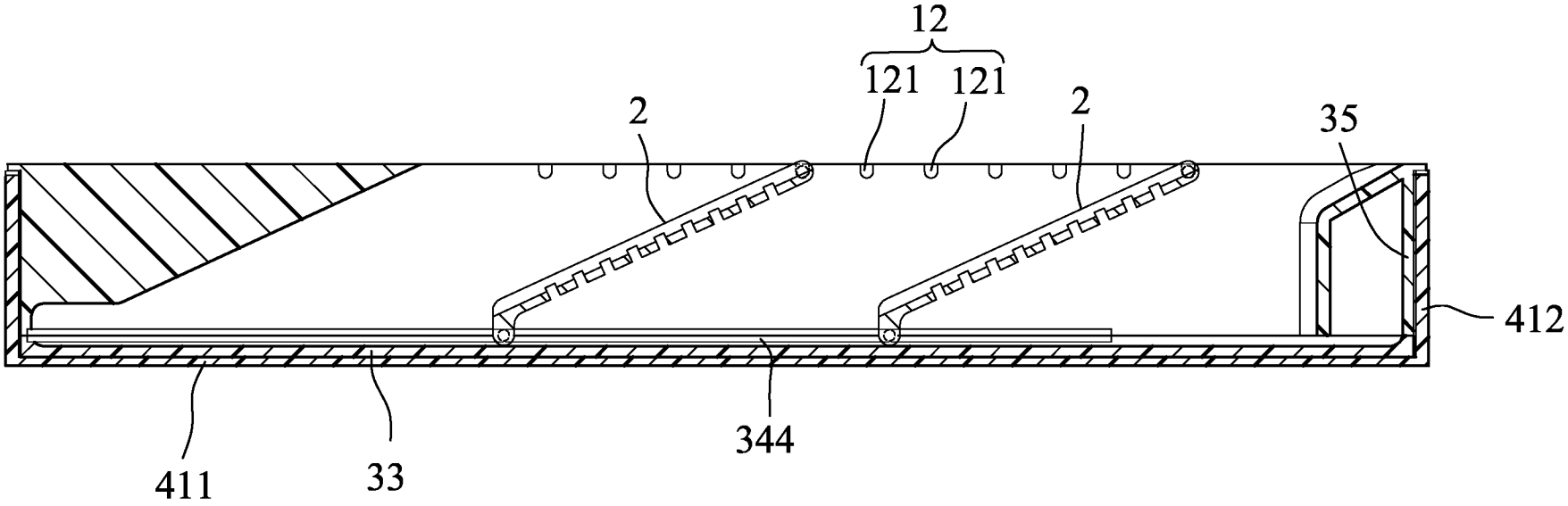
FIG. 9 is a sectional view taken along line 9-9 of FIG. 8.

Referring further to FIGS. 7 to 9, in the second embodiment, each of the flange sections 352 (only one is shown in FIG. 7) of the main box body 3 is formed with three positioning notches 353 arranged in the transverse direction (T). FIG. 7 illustrates the auxiliary box 4 at two positions respectively by solid and dash-dotted lines. In FIG. 7, each of the positioning protrusions 42 (only one is shown by a solid line in FIG. 7) separably engages one of the positioning notches 353 of the flange section 352 of the respective one of the second side walls 35 that is farthest from the first outer lateral surface 343 of the other one of the first side walls 34. The volume of the auxiliary space 43 changes as the auxiliary box 4 moves relative to the main box 1. When the auxiliary box 4 is moved in the transverse direction (T) toward the first outer lateral surface 343 of the other one of the first side walls 34, each of the positioning protrusions 42 is separated from the one of the positioning notches 353 of the flange section 352 of the respective one of the second side walls 35 and then separably engages the middle one of the positioning notches 353 of the flange section 352 of the respective one of the second side walls 35. At this time, the volume of the auxiliary space 43 is reduced. When each of the positioning protrusions 42 (only one is shown by a dash-dotted line in FIG. 7) separably engages one of the positioning notches 353 of the flange section 352 of the respective one of the second side walls 35 that is closest to the first outer lateral surface 343 of the other one of the first side walls 34, the main base wall 33 of the main box body 3 overlaps with the auxiliary base wall 411 of the auxiliary box body 41, and the auxiliary side wall 412 of the auxiliary box body 41 surrounds and abuts against the second side walls 35 and the one of the first side walls 34 so that the volume of the auxiliary space 43 is minimized. Therefore, in a scenario where the auxiliary space 43 is not needed for storing items (i.e., the auxiliary box 4 is considered to be non-essential in the scenario), the auxiliary box 4 may still remain coupled to the main box 1 to be prevented from being misplaced.

Figure 10:
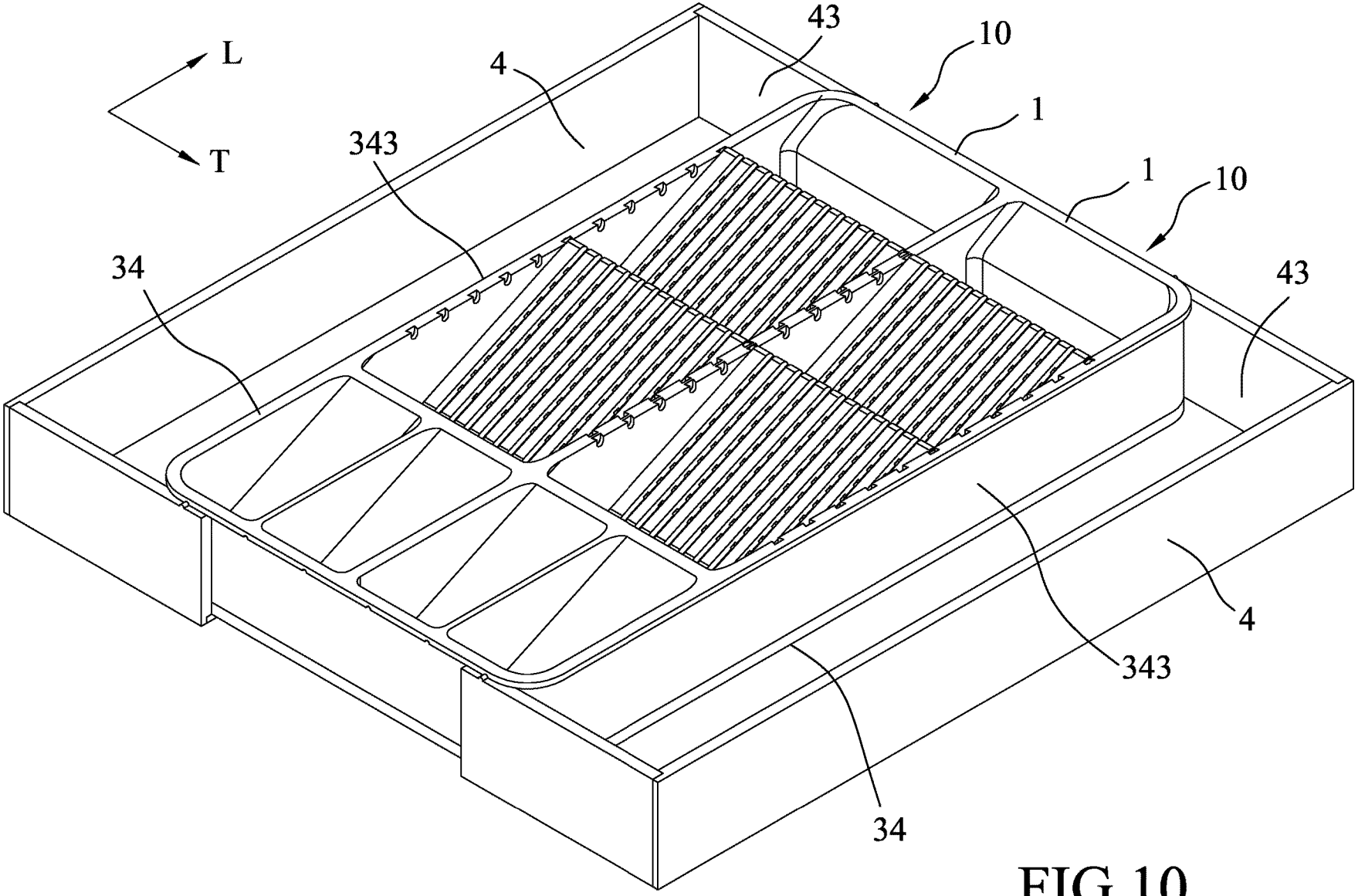
FIG. 10 is a perspective view of a third embodiment of the storage box.

Referring further to FIG. 10, a third embodiment of the storage box according to the disclosure is similar to the second embodiment. A difference between the second embodiment and the third embodiment is that the third embodiment of the storage box includes two storing units 10.

The main boxes 1 of the storing units 10 are arranged in the transverse direction (T) and are connected to each other. For each of the storing units 10, the auxiliary box 4 cooperates with the first outer lateral surface 343 of one of the first side walls 34 which is opposite to another one of the storing units 10 to define the auxiliary space 43.

In summary, by virtue of the dividing plate 2 being disposed removably in the dividable space 32 of the main box body 3, and by virtue of the auxiliary box 4 being movably coupled to the main box 1, the volume of each of the storage areas 321 of the main box body 3 is adjustable, especially in the longitudinal direction (L), according to the size of individual items that will be stored in the storage box, and the storage box provides the auxiliary space 43 whose volume is adjustable, especially in the transverse direction (T), according to the size of individual items. Therefore, the utility of the dividable space 32 of the main box body 3 is increased, and the items that the storage box is able to store may vary greatly in size and type. Furthermore, because the size of the storage box in the transverse direction (T) is adjustable, the storage box may fit into drawers of various sizes. Consequently, the purpose of the disclosure is certainly fulfilled.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A storage box comprising at least one storing unit including:

a main box that is elongated in a longitudinal direction, and that includes a main box body defining a dividable space that has an upward-facing top opening, and two first engaging subunits spaced apart from each other in a transverse direction which is perpendicular to the longitudinal direction, and formed on a top end of said main box body, each of said first engaging subunits including a plurality of spaced-apart first engaging members that are arranged in the longitudinal direction; and at least one dividing plate that has a plate body disposed removably in said dividable space and dividing said dividable space into two storage areas, and two second engaging members opposite to each other in the transverse direction, respectively connected to two opposite ends of said plate body, and respectively and separably engaging one of said first engaging members of one of said first engaging subunits and one of said first engaging members of the other one of said first engaging subunits;

wherein said main box body of said main box has a main base wall that has two first edges opposite to each other in the transverse direction, and two first side walls that extend upwardly and respectively from said first edges of said main base wall;

wherein each of said first engaging subunits is formed on a top end of a respective one of said first side walls;

wherein each of said first side walls has a first top surface that faces away from said main base wall, and a first inner lateral surface that extends downwardly from said first top surface and that faces said dividable space;

wherein, for each said first engaging subunit, each of said first engaging members is an indentation formed in an intersection of said first top surface and said first inner lateral surface of the respective one of said first side walls;

wherein said second engaging members of said at least one dividing plate are respectively connected to opposite ends of a top portion of said plate body, each of said second engaging members being a protrusion;

wherein each of said second engaging members has a circular cross section that is normal to the transverse direction and that has a diameter increasing as said second engaging member extends away from said plate body; and wherein each of said first engaging members of said first engaging subunits has a semi-circular shape.

2. The storage box as claimed in claim 1, wherein:

said at least one dividing plate of said at least one storing unit includes a plurality of dividing plates spaced apart from each other in the longitudinal direction, and said main box of said at least one storing unit further has a plurality of storing spaces isolated from said dividable space, each of said storing spaces having an upward-facing top opening.

3. The storage box as claimed in claim 1, wherein:

each of said first side walls of said main box body further has a slide groove indented at a bottom portion of said first inner lateral surface and extending in the longitudinal direction; and said at least one dividing plate further has two sliding members protruding respectively from opposite ends of a bottom portion of said plate body, each of said sliding members engaging rotatably and being slidable along said slide groove of a respective one of said first side walls so that said at least one dividing plate is rotatable and linearly movable relative to said main box body when said second engaging members are separated from said first engaging members of said first engaging subunits.

4. The storage box as claimed in claim 1, wherein:

said at least one dividing plate is inclined; and said plate body of said at least one dividing plate has a first plate surface that faces said main base wall of said main box body, a second plate surface that is opposite to said first plate surface, and a plurality of through holes that are spaced apart from each other, each of said through holes extending through said first plate surface and said second plate surface.

5. The storage box as claimed in claim 1, wherein:

each of said first side walls of said main box body further has a first outer lateral surface opposite to said dividable space; and said at least one storing unit further includes an auxiliary box movably coupled to said main box and cooperating with said first outer lateral surface of one of said first side walls to define an auxiliary space that has an upward-facing top opening.

6. The storage box as claimed in claim 5, wherein:

said main box body of said main box further has two second side walls spaced apart from each other in the longitudinal direction and interconnecting said first side walls; and each of said second side walls has a side wall section extending upwardly from said main base wall, and a flange section extending from a top end of said side wall section and away from another one of said second side walls, and formed with a plurality of positioning notches that are spaced apart from each other, that are arranged in the transverse direction, and that open downwardly.

7. The storage box as claimed in claim 6, wherein:

said auxiliary box has an auxiliary box body and two positioning protrusions spaced apart from each other in the longitudinal direction and protruding upwardly from said auxiliary box body;

each of said positioning protrusions separably engages one of said positioning notches of a respective one of said second side walls of said main box; and a volume of said auxiliary space changes as said auxiliary box moves relative to said main box.

8. The storage box as claimed in claim 5, wherein:

said at least one storing unit includes two storing units arranged in the transverse direction and connected to each other; and for each of said storing units, said auxiliary box cooperates with said first outer lateral surface of one of said first side walls which is opposite to another one of said storing units to define said auxiliary space.

9. A storage box comprising at least one storing unit including:

a main box that is elongated in a longitudinal direction, and that includes a main box body defining a dividable space that has an upward-facing top opening, and two first engaging subunits spaced apart from each other in a transverse direction which is perpendicular to the longitudinal direction, and formed on a top end of said main box body, each of said first engaging subunits including a plurality of spaced-apart first engaging members that are arranged in the longitudinal direction; and at least one dividing plate that has a plate body disposed removably in said dividable space and dividing said dividable space into two storage areas, and two second engaging members opposite to each other in the transverse direction, respectively connected to two opposite ends of said plate body, and respectively and separably engaging one of said first engaging members of one of said first engaging subunits and one of said first engaging members of the other one of said first engaging subunits;

wherein said main box body of said main box has a main base wall that has two first edges opposite to each other in the transverse direction, and two first side walls that extend upwardly and respectively from said first edges of said main base wall;

wherein each of said first engaging subunits is formed on a top end of a respective one of said first side walls;

wherein each of said first side walls has a first top surface that faces away from said main base wall, and a first inner lateral surface that extends downwardly from said first top surface and that faces said dividable space;

wherein, for each said first engaging subunit, each of said first engaging members is an indentation formed in an intersection of said first top surface and said first inner lateral surface of the respective one of said first side walls;

wherein said second engaging members of said at least one dividing plate are respectively connected to opposite ends of a top portion of said plate body, each of said second engaging members being a protrusion;

wherein each of said first side walls of said main box body further has a slide groove that is indented at a bottom portion of said first inner lateral surface and that extends in the longitudinal direction; and wherein said at least one dividing plate further has two sliding members that protrude respectively from opposite ends of a bottom portion of said plate body, each of said sliding members engaging rotatably and being slidable along said slide groove of a respective one of said first side walls so that said at least one dividing plate is rotatable and linearly movable relative to said main box body when said second engaging members are separated from said first engaging members of said first engaging subunits.

10. The storage box as claimed in claim 9, wherein:

said at least one dividing plate of said at least one storing unit includes a plurality of dividing plates spaced apart from each other in the longitudinal direction, and said main box of said at least one storing unit further has a plurality of storing spaces isolated from said dividable space, each of said storing spaces having an upward-facing top opening.

11. The storage box as claimed in claim 9, wherein:

each of said second engaging members has a circular cross section that is normal to the transverse direction and that has a diameter increasing as said second engaging member extends away from said plate body; and each of said first engaging members of said first engaging subunits has a semi-circular shape.

12. The storage box as claimed in claim 9, wherein:

said at least one dividing plate is inclined; and said plate body of said at least one dividing plate has a first plate surface that faces said main base wall of said main box body, a second plate surface that is opposite to said first plate surface, and a plurality of through holes that are spaced apart from each other, each of said through holes extending through said first plate surface and said second plate surface.

13. The storage box as claimed in claim 9, wherein:

each of said first side walls of said main box body further has a first outer lateral surface opposite to said dividable space; and said at least one storing unit further includes an auxiliary box movably coupled to said main box and cooperating with said first outer lateral surface of one of said first side walls to define an auxiliary space that has an upward-facing top opening.

14. The storage box as claimed in claim 13, wherein:

said main box body of said main box further has two second side walls spaced apart from each other in the longitudinal direction and interconnecting said first side walls; and each of said second side walls has a side wall section extending upwardly from said main base wall, and a flange section extending from a top end of said side wall section and away from another one of said second side walls, and formed with a plurality of positioning notches that are spaced apart from each other, that are arranged in the transverse direction, and that open downwardly.

15. The storage box as claimed in claim 14, wherein:

said auxiliary box has an auxiliary box body and two positioning protrusions spaced apart from each other in the longitudinal direction and protruding upwardly from said auxiliary box body;

each of said positioning protrusions separably engages one of said positioning notches of a respective one of said second side walls of said main box; and a volume of said auxiliary space changes as said auxiliary box moves relative to said main box.

16. The storage box as claimed in claim 13, wherein:

said at least one storing unit includes two storing units arranged in the transverse direction and connected to each other; and for each of said storing units, said auxiliary box cooperates with said first outer lateral surface of one of said first side walls which is opposite to another one of said storing units to define said auxiliary space.

* * * * *